US005650025A

United States Patent [19]

Han

[11] Patent Number: 5,650,025

[45] Date of Patent: Jul. 22, 1997

[54] WEAR-RESISTANT ALUMINUM ALLOY FOR AUTOMOBILE PARTS

[75] Inventor: Do-Suck Han, Kyungsangnam-do, Rep. of Korea

[73] Assignee: Hyundai Motor Company, Seoul, Rep. of Korea

[21] Appl. No.: 555,806

[22] Filed: Nov. 9, 1995

[30] Foreign Application Priority Data

Nov. 10, 1994 [KR] Rep. of Korea ..... 94-29397

[51] Int. Cl.[6] ..... C22C 21/04

[52] U.S. Cl. ..... 148/439; 420/532; 420/535; 420/537; 420/538

[58] Field of Search ..... 420/532, 534, 420/535, 537, 538, 541, 544, 546, 547, 551, 552, 553; 148/439

[56] References Cited

FOREIGN PATENT DOCUMENTS

| | | |
|---|---|---|
| 53-37810 | 4/1978 | Japan . |
| 54-8324 | 1/1979 | Japan . |
| 2-61023 | 3/1990 | Japan . |

OTHER PUBLICATIONS

"ASM Specialty Handbook: Aluminum and Aluminum Alloys", J.R. Davis, ed.; ASM International, Materials Park, Ohio; 1993, p. 725.

*Primary Examiner*—George Wyszomierski
*Attorney, Agent, or Firm*—Finnegan, Henderson, Farabow, Garrett & Dunner

[57] ABSTRACT

A wear-resistant aluminum alloy for automobile parts, particularly for automobile engine and transmission parts requiring high strength, toughness, and wear-resistance, prepared by increasing the amount of silicon, copper, magnesium, and titanium, and decreasing the amount of zinc.

7 Claims, No Drawings

WEAR-RESISTANT ALUMINUM ALLOY FOR AUTOMOBILE PARTS

BACKGROUND OF THE INVENTION

This invention relates to wear-resistant aluminum alloy for automobile parts, particularly, to an aluminum alloy for automobile engine and transmission parts having high strength and toughness, and excellent wear-resistance which is prepared by increasing the amount of silicon, copper, magnesium and titanium, and decreasing the amount of zinc.

A typical, die casting aluminum alloy having wear-resistance consists essentially of 16.0 to 18.0 wt. % of silicon, 4.0 to 5.0 wt. % of copper, 0.45 to 0.65 wt. % of magnesium, less than 1.3 wt. % of zinc, less than 1.3 wt. % of iron, less than 0.5 wt. % of manganese, less than 0.1 wt. % of nickel and less than 0.2 wt. % of titanium, which shows excellent tensile strength and wear-resistance, but elongation is low due to sludge factor of impurities such as tin etc. Accordingly, when it is used for automobile parts, particularly a manual transmission(MTM) shift fork, it may be broken.

Japanese patent non-examination pyoung 2-61023 discloses another aluminum alloy which shows good thermal resistance and wear-resistance, wherein the aluminum alloy comprises 5 to 35 wt. % of silicon, 1 to 15 wt. % of iron, 0.3 to 10 wt. % of manganese, and 0.1 to 5 wt. % of cerium, tungsten, titanium or molybdenum and the average diameter of the silicon is 20 μm.

The aluminum alloy of the above composition has good thermal resistance and wear-resistance, but it has severe brittleness at the elevated temperature and a low toughness at room temperature.

This invention solves these problems associated with the conventional aluminum alloys. The preferred aluminum alloy of this invention shows excellent strength, toughness and wear-resistance, and is prepared by increasing the amount of silicon etc., decreasing the amounts of zinc and newly adding titanium and berylium.

SUMMARY OF THE INVENTION

An object of this invention is to provide aluminum alloy for automobile parts having a new composition and showing excellent strength and toughness, and excellent wear-resistance.

The preferred composition of this invention is an aluminum alloy composition for automobile parts comprising of 18.0 to 25.0 wt. % of silicon, 5.0 to 6.0 wt. % of copper, 0.65 to 1.0 wt. % of magnesium, less than 0.3 wt. % of zinc, 0.6 to 1.0 wt. % of iron, less than 0.3 wt. % of manganese, less than 0.1 wt. % of nickel, 0.2 to 0.5 wt. % of titanium, 0.1 to 0.5 wt. % of beryllium and 0.1 to 0.2 wt. % of phosphorus, and aluminum as remainder.

DETAILED DESCRIPTION OF THE INVENTION

This invention relates to an aluminum alloy for automobile parts of which strength, toughness and wear-resistance is improved by a new composition.

In this invention, silicon is used in the range of 18.0 to 25.0 wt. %, accordingly the quantity is increased comparing with the former alloy. If the content is below or over this range, its wear-resistance may be reduced.

The size of silicon is controlled to be 10 to 50 μm, and 90% of the phase is controlled to be 20 to 40 μm to thereby improve machinability and wear-resistance.

In addition, copper and magnesium are used in the range of 5.0 to 6.0 wt. % and 0.65 to 1.0 wt. %, respectively, accordingly its strength is increased by forming precipitates such as $CuAl_2$ and $Mg_2Si$. If the content is below or over these range, its strength may be reduced or cost may be increased.

Phosphorus is used in the range of 0.1 to 0.2 wt. % to increase the machinability and wear-resistance of aluminum alloy by micronizing and uniformly dispersing primary silicon.

By micronizing silicon organization due to addition of titanium and beryllium, the wear-resistance of the aluminum alloy is improved, and by decreasing amount of zinc, tin and nickel, the toughness of the aluminum alloy is improved.

The aluminum alloy prepared by this invention has high strength and toughness, and excellent wear-resistance by increasing or newly adding silicon, copper, magnesium, titanium, beryllium and phosphorus, accordingly this alloy is very useful in engine cylinder block and transmission parts of an automobile.

This invention may be illustrated in more detail as following examples, but it is not limited by the examples.

EXAMPLE 1 to 5, COMPARATIVE EXAMPLE 1 to 2

According to mixing ratios of the following Table 1 and the following method, aluminum alloy was prepared.

1. By using pure aluminum(purity: 99%) and silicon metal(purity: 98%), aluminum-30 wt. % of silicon, a mother alloy was prepared in a conductive furnace.

2. The aluminum 30 wt. % of silicon mother alloy was added into an electric resistant furnace and kept in at a temperature of 700° to 750° C.

3. Herein, A 356 alloy was added after comlpletely melting.

4. Stirring after completely melting and slag treatment was carried out. The temperature was kept at 700° to 750° C., and slag instruments were pre-heated at 250° C. for 30 minutes to prevent gas mixing.

5. The following alloy components were added quickly, accurately and safely.

5-1. Copper(98% of purity).

5-2. Aluminum-75 wt. % of iron mother alloy.

5-3. Magnesium was added after magnesium was wrapped in aluminum foil and pre-heated on the cap of the furnace to prevent evaporation on surface of melt.

6. Slag treatment was carried out after completely melting.

7. After raising the temperature to 840°–880° C., an aluminum-copper-phosphorus alloy was added to micronize primary silicon, and it was maintained for 30 to 120 minutes.

8. Titanium and beryllium were concurrently added to micronize eutectic silicon, slag treatment was carried out, and stirring was carried out for 10 to 30 minutes.

9. Degasing and slag treatement were then carried out without stirring the melt.

10. A mold release agent was applied to an inner surface of a mold. The mold was pre-heated at 250° C. for 30 minutes, and the melt was poured into the mold to prepare specimens.

Tables 1 and 2 disclose several embodiments of the claimed invention and compare the properties of the exemplified alloy with other alloys.

TABLE 1

| section | components | | | | | | | | | | | |
|---|---|---|---|---|---|---|---|---|---|---|---|---|
| | Si | Cu | Mg | Zn | Fe | Mn | Ni | Sn | Ti | Be | P | Al |
| Example 1 | 24.6 | 5.7 | 0.94 | 0.01 | 0.65 | 0.26 | 0.05 | 0.001 | 0.35 | 0.14 | 0.12 | the remainder |
| Example 2 | 22.3 | 5.4 | 0.91 | 0.15 | 0.72 | 0.24 | 0.01 | 0.001 | 0.46 | 0.15 | 0.13 | the remainder |
| Example 3 | 23.7 | 5.8 | 0.83 | 0.09 | 0.66 | 0.18 | 0.07 | 0.001 | 0.27 | 0.18 | 0.12 | the remainder |
| Example 4 | 19.2 | 5.1 | 0.85 | 0.24 | 0.81 | 0.18 | 0.04 | 0.001 | 0.38 | 0.13 | 0.16 | the remainder |
| Example 5 | 18.5 | 5.2 | 0.83 | 0.27 | 0.74 | 0.25 | 0.04 | 0.001 | 0.37 | 0.12 | 0.15 | the remainder |
| Comparative Example 1(1) | 16.0–18.0 | 4.0–5.0 | 0.45–0.65 | 0.1 | 0.6–1.1 | 0.1 | — | — | 0.02 | — | — | the remainder |
| Comparative Example 2(2) | 13.5–15.5 | 4.0–5.0 | 0.5 | 1.0 | 1.3 | 0.5 | 0.5 | 0.3 | — | — | — | the remainder |

Note;
(1)the known 390
(2)R14 (Japanese patent non-examination Sho 53-37810 and Sho 54-8324)

TABLE 2

| section | properties | | | | |
|---|---|---|---|---|---|
| | Tensile strength(1) (kgf/mm$^2$) | Static fracture load(2) (kg) | Elongation(3) (%) | Impact strength(4) (kg · m/cm) | Amount of wear(5) (mm) |
| Example 1 | 27.0 | 290 | 0.52 | 0.57 | 0.005 |
| Example 2 | 28.5 | 300 | 0.48 | 0.49 | 0.004 |
| Example 3 | 27.6 | 290 | 0.50 | 0.54 | 0.005 |
| Example 4 | 29.4 | 310 | 0.48 | 0.51 | 0.004 |
| Example 5 | 29.0 | 305 | 0.49 | 0.49 | 0.004 |
| Comparative Example 1 | 27.0 | 280 | 0.30 | 0.30 | 0.013 |
| Comparative Example 2 | 23.2 | 265 | 0.43 | 0.49 | 0.026 |

Note;
(1)Tensile strength: Tensile strength was measured by 25 TON UTM.
(2)Static fracture load: Static fracture load was measured by 10 TON UTM.
(3)Elongation: Elongation was measured by 25 TON UTM.
(4)Impact strength: Impact strength was measured by Charpy impacting test.
(5)Amount of wear: Amount of wear was measured by PIN-ON-DISC wear test.

What is claimed is:

1. A wear-resistant aluminum alloy consisting essentially of 18.0 to 25.0 wt. % of silicon, 5.0 to 6.0 wt. % of copper, 0.65 to 1.0 wt. % of magnesium, less than 0.3 wt. % of zinc, 0.6 to 1.0 wt. % of iron, less than 0.3 wt. % of manganese, less than 0.1 wt. % of nickel, 0.2 to 0.5 wt. % of titanium, 0.1 to 0.5 wt. % of beryllium, 0.1 to 0.2 wt. % of phosphorus, and aluminum as remainder.

2. The wear-resistant aluminum alloy of claim 1, comprising a silicon phase, wherein the size of the silicon phase is 10 to 50 μm.

3. The wear-resistant aluminum alloy of claim 2, wherein 90% of the silicon phase is 20 to 40 μm in size.

4. The wear-resistant aluminum alloy of claim 1, wherein the alloy has a tensile strength equal to or greater than 27 kgf/mm$^2$, and elongation equal to or greater than 0.48%.

5. The wear resistant aluminum alloy of claim 1, wherein zinc is present in an amount of 0.01 to 0.3 weight percent.

6. The wear resistant aluminum alloy of claim 1, wherein nickel is present in an amount of 0.01 to 0.1 weight percent.

7. A wear resistant aluminum alloy consisting essentially of 18.5 to 25 wt. % silicon, 5.1 to 6 wt. % percent copper, 0.83 to 1 wt. % magnesium, 0.01 to 0.3 wt. % of zinc, 0.6 to 1.0 wt. % of iron, 0.18 to 0.3 wt. % of manganese, 0.01 to 0.1 wt. % of nickel, 0.27 to 0.5 wt. % of titanium, 0.1 to 0.5 wt. % of beryllium, 0.1 to 0.2 wt. % of phosphorus, and aluminum as remainder.

* * * * *